US011181837B2

(12) United States Patent
Sekiya et al.

(10) Patent No.: US 11,181,837 B2
(45) Date of Patent: Nov. 23, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Michiyo Sekiya, Atami (JP); Kaname Watariguchi, Yokohama (JP); Masataka Kawahara, Mishima (JP); Tomohito Ishida, Suntou-gun (JP); Kohei Makisumi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/904,700

(22) Filed: Jun. 18, 2020

(65) Prior Publication Data

US 2020/0409279 A1 Dec. 31, 2020

(30) Foreign Application Priority Data

Jun. 25, 2019 (JP) ..... JP2019-117811

(51) Int. Cl.
*G03G 5/047* (2006.01)
*G03G 15/00* (2006.01)
(Continued)

(52) U.S. Cl.
CPC ..... *G03G 5/047* (2013.01); *G03G 5/0696* (2013.01); *G03G 15/751* (2013.01); *G03G 21/1814* (2013.01)

(58) Field of Classification Search
CPC ..... G03G 5/047
See application file for complete search history.

(56) References Cited

U.S. PATENT DOCUMENTS 5,455,135 A 10/1995 Maruyama et al.
5,693,443 A 12/1997 Nakamura et al.
(Continued)

FOREIGN PATENT DOCUMENTS

JP S62-295057 12/1987
JP H07-287435 10/1995
(Continued)

OTHER PUBLICATIONS

U.S. Appl. No. 16/891,525, Shuhei Iwasaki, filed Jun. 3, 2020.
(Continued)

*Primary Examiner* — Christopher D Rodee
(74) *Attorney, Agent, or Firm* — Venable LLP

(57) ABSTRACT

An electrophotographic photosensitive member, including a cylindrical support, a charge generating layer formed on the cylindrical support, and a charge transport layer formed on the charge generating layer, in which in the charge generating layer, when a region from a central position of an image forming region to an end position of the image forming region in an axis direction of the cylindrical support is divided equally into five regions, film thicknesses of the charge generating layers in each of the regions satisfy a specific relationship with each other, and in the charge transport layer, when a region from the central position of the image forming region to the end position of the image forming region in the axis direction of the cylindrical support is divided equally into five regions, film thicknesses of the charge transport layers in each of the regions satisfy a specific relationship with each other.

7 Claims, 8 Drawing Sheets

(51) Int. Cl.
*G03G 21/18* (2006.01)
*G03G 5/06* (2006.01)

(56) References Cited

U.S. PATENT DOCUMENTS 5,910,386 A 6/1999 Yoshinaga et al.
6,110,628 A 8/2000 Sekiya et al.
6,258,498 B1 7/2001 Kawahara et al.
6,296,978 B1 10/2001 Takaya et al.
6,372,397 B1 4/2002 Maruyama et al.
6,436,597 B2 8/2002 Maruyama et al.
6,551,752 B2 4/2003 Takaya et al.
6,623,899 B2 9/2003 Takaya et al.
6,664,014 B1 12/2003 Kikuchi et al.
7,141,341 B2 11/2006 Sekido et al.
7,316,876 B2 * 1/2008 Kobayashi ..... G03G 5/0564 430/123.4
7,333,752 B2 2/2008 Kawahara et al.
7,378,205 B2 5/2008 Sekiya et al.
7,551,878 B2 6/2009 Ogaki et al.
7,622,238 B2 11/2009 Uematsu et al.
7,629,102 B2 12/2009 Ochi et al.
7,642,025 B2 * 1/2010 Tada ..... G03G 17/06 430/56
7,718,331 B2 5/2010 Uematsu et al.
7,749,667 B2 7/2010 Kawahara et al.
8,088,541 B2 1/2012 Tanaka et al.
8,343,699 B2 1/2013 Nagasaka et al.
8,465,889 B2 6/2013 Sekido et al.
8,524,430 B2 9/2013 Takagi et al.
8,546,050 B2 10/2013 Maruyama et al.
8,632,931 B2 1/2014 Sekido et al.
8,795,936 B2 8/2014 Sekido et al.
8,841,052 B2 9/2014 Watariguchi et al.
9,029,054 B2 5/2015 Okuda et al.
9,063,505 B2 6/2015 Sekiya et al.
9,068,083 B2 6/2015 Tanaka et al.
9,069,267 B2 6/2015 Kaku et al.
9,436,106 B2 9/2016 Kuno et al.
9,459,542 B2 10/2016 Tanaka et al.
9,459,545 B2 10/2016 Tanaka et al.
9,500,966 B2 11/2016 Watariguchi et al.
9,523,929 B2 12/2016 Nakamura et al.
9,535,346 B2 1/2017 Sekiya et al.
9,535,347 B2 1/2017 Watariguchi et al.
9,541,850 B2 1/2017 Nishida et al.
9,563,139 B2 2/2017 Kawahara et al.
9,645,515 B2 5/2017 Kuno et al.
9,645,516 B2 5/2017 Kawahara et al.
9,760,030 B2 9/2017 Sekiya et al.
9,772,568 B2 9/2017 Sekido et al.
9,811,011 B2 11/2017 Nishi et al.
9,851,648 B2 12/2017 Nishi et al.
9,864,285 B2 1/2018 Nishi et al.
9,869,032 B2 1/2018 Kawahara et al.
9,921,498 B2 3/2018 Sekido et al.
10,372,050 B2 8/2019 Nishi et al.
2008/0096123 A1 4/2008 Shimada et al.
2009/0170023 A1 7/2009 Shimada et al.
2014/0141362 A1 5/2014 Watariguchi et al.
2015/0093693 A1 4/2015 Watariguchi et al.
2015/0185630 A1 7/2015 Ito et al.
2015/0185634 A1 7/2015 Sekiya et al.
2015/0316863 A1 11/2015 Tanaka et al.
2015/0346617 A1 12/2015 Kawahara et al.
2015/0362847 A1 12/2015 Tanaka et al.
2016/0091807 A1 3/2016 Tanaka et al.
2016/0131985 A1 5/2016 Tanaka et al.
2016/0154326 A1 6/2016 Kumoi et al.
2016/0154328 A1 6/2016 Kumoi et al.
2020/0159137 A1 5/2020 Ito et al.
2020/0174385 A1 6/2020 Sakakibara et al.
2021/0124277 A1 * 4/2021 Heid ..... G03G 5/04
2021/0124278 A1 * 4/2021 Heid ..... G03G 5/047

FOREIGN PATENT DOCUMENTS

JP 2001-305838 11/2001
JP 2002-174910 6/2002

OTHER PUBLICATIONS

U.S. Appl. No. 16/903,525, Kohei Makisumi, filed Jun. 17, 2020.
U.S. Appl. No. 16/904,705, Tomohito Ishida, filed Jun. 18, 2020.
U.S. Appl. No. 16/905,427, Kaname Watariguchi, filed Jun. 18, 2020.
U.S. Appl. No. 17/065,258, Kohei Makisumi, filed Oct. 7, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge having the electrophotographic photosensitive member and an electrophotographic apparatus having the electrophotographic photosensitive member.

Description of the Related Art

Recently, a semiconductor laser has prevailed as an exposing unit that is used in an electrophotographic apparatus. In general, a laser beam exiting from a light source is scanned in an axis direction of a cylindrical electrophotographic photosensitive member (hereinafter, also simply referred to as a photosensitive member) by a laser scan writing apparatus. A light amount that is applied to the photosensitive member is controlled by an optical system, such as a polygon mirror, various electric correction units, and the like that are used at this time such that the light amount is homogeneous in the axis direction of the photosensitive member.

The cost of the polygon mirror described above has been reduced or the optical system has been downsized in accordance with the improvement of an electric correction technology or the like, and thus, an electrophotographic laser beam printer for a personal use has been used, but recently, a further reduction in the cost and the size has been required.

In a case where the optical system described above is not devised or electric correction is not performed, laser light that is scanned by the laser scan writing apparatus described above has a deviation in a light amount distribution with respect to axis direction of the photosensitive member. In particular, the laser beam is scanned by the polygon mirror or the like, and thus, there is a region in which the light amount decreases from a central portion toward an end portion in the axis direction of the photosensitive member. In a case where such a deviation in the light amount distribution is homogenized by the control of the optical system, the electric correction, or the like, an increase in the cost and the size is caused.

Therefore, in the photosensitive member of the related art, a sensitivity distribution is provided in the axis direction of the photosensitive member such that the deviation in the light amount distribution described above is cancelled, and thus, an exposure potential distribution is homogenized in the axis direction of the photosensitive member.

As a method of providing a suitable sensitivity distribution in the photosensitive member, it is effective to provide a suitable distribution in a photoelectric conversion efficiency of a charge generating layer in a laminated photosensitive member.

In Japanese Patent Application Laid-Open No. 2001-305838, a technology is described in which a deviation is provided in a film thickness of the charge generating layer of the photosensitive member by speed control in dip coating, and thus, the value of a Macbeth concentration is changed. The photosensitive member has a deviation in the distribution of the Macbeth concentration in the axis direction, and thus, a light absorption amount of the charge generating layer is changed in the axis direction of the photosensitive member, and a suitable distribution is provided in the photoelectric conversion efficiency.

According to the study of the present inventors, in the electrophotographic photosensitive member described in Japanese Patent Application Laid-Open No. 2001-305838, a ghost phenomenon was remarkably observed on the end portion of the photosensitive member in the axis direction.

Therefore, an object of the present invention is to provide an electrophotographic photosensitive member in which a suitable sensitivity distribution is provided in a photosensitive member in an axis direction, and a ghost phenomenon on an end portion of the photosensitive member in the axis direction is suppressed.

SUMMARY OF THE INVENTION

The object described above is attained by the present invention described below. That is, an electrophotographic photosensitive member according to one aspect of the present invention is an electrophotographic photosensitive member, including a cylindrical support, a charge generating layer formed on the cylindrical support, and a charge transport layer formed on the charge generating layer, in which in the charge generating layer, when a region from a central position of an image forming region to an end position of the image forming region in an axis direction of the cylindrical support is divided equally into five regions, and average values of film thicknesses [μm] of the charge generating layers in each of the regions obtained by being divided equally are respectively defined as $d_{11}$, $d_{12}$, $d_{13}$, $d_{14}$, and $d_{15}$ in order from the central position of the image forming region toward the end position of the image forming region, the film thickness of the charge generating layer satisfies a relationship of $d_{11}<d_{12}<d_{13}<d_{14}<d_{15}$, and in the charge transport layer, when a region from the central position of the image forming region to the end position of the image forming region in the axis direction of the cylindrical support is divided equally into five regions, and average values of film thicknesses [μm] of the charge transport layers in each of the regions obtained by being divided equally are respectively defined as $d_{21}$, $d_{22}$, $d_{23}$, $d_{24}$, and $d_{25}$ in order from the central position of the image forming region toward the end position of the image forming region, the film thickness of the charge transport layer satisfies a relationship of $d_{21}>d_{22}>d_{23}>d_{24}>d_{25}$.

In addition, a process cartridge according to another aspect of the present invention integrally supports the electrophotographic photosensitive member described above and at least one unit selected from the group consisting of a charging unit, a developing unit, a transfer unit, and a cleaning unit, and is detachably attachable with respect to a main body of an electrophotographic apparatus.

Further, an electrophotographic apparatus according to another aspect of the present invention, includes the electrophotographic photosensitive member described above, a charging unit, an exposing unit, a developing unit, and a transfer unit.

Further features of the present invention will become apparent from the following description of exemplary embodiments with reference to the attached drawings.

DESCRIPTION OF THE EMBODIMENTS

Figure 1:
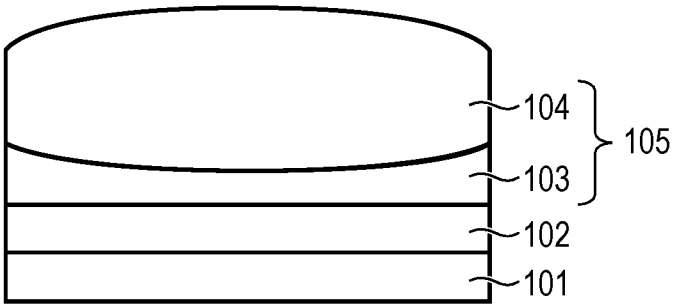
FIG. 1 is a diagram illustrating an example of a layer configuration of an electrophotographic photosensitive member according to the present invention.

Hereinafter, the present invention will be described in detail with preferred embodiments.

In an exposed portion of an electrophotographic photosensitive member, charges retained in a charge generating layer are discharged in the next charging, and thus, a potential after charging decreases, and a ghost phenomenon occurs. A sensitivity distribution is provided in a photosensitive member such that a deviation in a light amount distribution of laser light emitted from a laser scan writing apparatus, in an axis direction of the photosensitive member is cancelled, and thus, an exposure potential distribution in the axis direction of the photosensitive member can be homogenized. However, even in a case where the exposure potential distribution can be homogenized, the retention and the discharge of the charge that are the causes of the ghost phenomenon are not homogeneous in the axis direction of photosensitive member, a potential drop increases toward an end portion side of the photosensitive member in the axis direction, and a positive ghost phenomenon occurs.

In the study of the present inventors, it has been found that the retention of the charge that is the cause of the positive ghost depends not only on the number of generated charges but also on a film thickness of the charge generating layer. As the reason thereof, it is considered that even in a case where the number of generated charges is the same regardless the film thickness, a position in which the charges are trapped increases in accordance with the film thickness.

From the study described above, it is considered that in a position in which the film thickness of the charge generating layer is large, it is necessary to increase a discharge effect of the retained charges, and thus, a film thickness of a charge transport layer is changed in accordance with the film thickness of the charge generating layer.

That is, it has been found that the occurrence of the ghost phenomenon on the end portion side of the photosensitive member in the axis direction, in the related art technology, can be solved by using an electrophotographic photosensitive member according to one aspect of the present invention described below. In the electrophotographic photosensitive member according to one aspect of the present invention, in a charge generating layer, when a region from a central position of an image forming region to an end position of the image forming region in an axis direction of a cylindrical support is divided equally into five regions, and average values of film thicknesses [μm] of the charge generating layers in each of the regions obtained by being divided equally are respectively defined as $d_{11}$, $d_{12}$, $d_{13}$, $d_{14}$, and $d_{15}$ in order from the central position of the image forming region toward the end position of the image forming region, the film thickness of the charge generating layer satisfies a relationship of $d_{11}<d_{12}<d_{13}<d_{14}<d_{15}$, and in a charge transport layer, when a region from the central position of the image forming region to the end position of the image forming region in the axis direction of the cylindrical support is divided equally into five regions, and average values of film thicknesses [μm] of the charge transport layers in each of the regions obtained by being divided equally are respectively defined as $d_{21}$, $d_{22}$, $d_{23}$, $d_{24}$, and $d_{25}$ in order from the central position of the image forming region toward the end position of the image forming region, the film thickness of the charge transport layer satisfies a relationship of $d_{21}>d_{22}>d_{23}>d_{24}>d_{25}$.

In the present invention, it is preferable that in the $d_{11}$, the die, the do, the $d_{14}$, the $d_{15}$, the $d_{21}$, the $d_{22}$, the $d_{23}$, the $d_{24}$, and the $d_{25}$, each value that is calculated by $d_{11}\times d_{21}$, $d_{12}\times d_{22}$, $d_{13}\times d_{23}$, $d_{14}\times d_{24}$, and $d_{15}\times d_{25}$ is 1.0 or more and 3.0 or less. Accordingly, it is found that the occurrence of the ghost phenomenon can be more effectively suppressed. The film thickness of the charge transport layer for obtaining the discharge effect of the retained charges has a suitable range in accordance with the film thickness of the charge generating layer. That is, in a case where a value obtained by multiplying the film thickness of the charge generating layer by the film thickness of the charge transport layer in the corresponding region is 3.0 or less, the discharge effect of the charges can be sufficiently obtained, and the occurrence of the positive ghost can be suppressed. On the other hand, a value obtained by multiplying the film thickness of the charge generating layer by the film thickness of the charge transport layer in the corresponding region is 1.0 or more, the discharge effect of the charges can be obtained, and the occurrence of negative ghost due to the influence of transfer can be suppressed.

In addition, for example, a moderate ghost image may be visually more noticeable in a case there is a concentration difference between the end portion and the central portion of the image forming region. In contrast, it is preferable that in the $d_{11}$, the $d_{12}$, the do, the $d_{14}$, the $d_{15}$, the $d_{21}$, the $d_{22}$, the $d_{23}$, the $d_{24}$, and the $d_{25}$, a standard deviation of five values that are calculated by $d_{11}\times d_{21}$, $d_{12}\times d_{22}$, $d_{13}\times d_{23}$, $d_{14}\times d_{24}$, and $d_{15}\times d_{25}$ is 0.3 or less. Accordingly, a potential drop is approximately homogeneous from the central position of the image forming region toward the end position of the image forming region, and thus, the concentration difference between the end portion and the central portion of the image forming region decreases, and it is possible to prevent the ghost image from being visually noticeable.

Note that, in the present invention, in a case where the electrophotographic photosensitive member includes a protection layer, and the protection layer contains a charge transport substance, the $d_{21}$, the $d_{22}$, the $d_{23}$, the $d_{24}$, and the $d_{25}$ are values obtained with respect to a layer including the protection layer and the charge transport layer.

[Electrophotographic Photosensitive Member]

The electrophotographic photosensitive member according to one aspect of the present invention includes a cylindrical support, a charge generating layer formed on the cylindrical support, and a charge transport layer formed on the charge generating layer.

Figure 2:
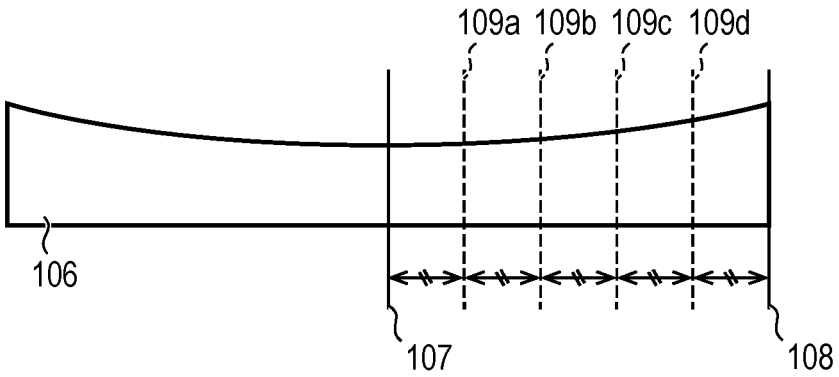
FIG. 2 is a diagram illustrating that an image forming region of a charge generating layer is divided equally into five regions from a central position to an end position.

FIG. 1 is a diagram illustrating an example of a layer configuration of the electrophotographic photosensitive member according to the present invention. In FIG. 1, the support is represented by 101, an undercoat layer is represented by 102, the charge generating layer is represented by 103, the charge transport layer is represented by 104, and a photosensitive layer is represented by 105. In the present invention, the undercoat layer 102 may not be provided. FIG. 2 is a diagram illustrating that the image forming region of the charge generating layer is divided equally into five regions from the central position to the end position. In FIG. 2, a sectional surface of the charge generating layer in the image forming region is represented by 106, the central position of the image forming region is represented by 107, the end position of the image forming region is represented by 108, and internally divided positions when the region from the central position of the image forming region to the end position of the image forming region is divided equally into five regions are represented by 109*a* to 109*d*. An average value of the film thicknesses of the charge generating layer in a region interposed between 107 and 109*a* is represented by $d_{11}$ [μm]. Similarly, average values of the film thicknesses of the charge generating layers in the regions interposed between 109*a* and 109*b*, 109*b* and 109*c*, 109*c* and 109*d*, and 109*d* and 108 are represented by $d_{12}$, $d_{13}$, $d_{14}$, and $d_{15}$ [μm], respectively.

Examples of a method of manufacturing the electrophotographic photosensitive member according to one aspect of the present invention include a method of preparing a coating liquid for each layer described below, of applying the coating liquid in the order of a desired layer, and of drying the coating liquid. At this time, examples of a coating method of the coating liquid include dip coating, spray coating, inkjet coating, roll coating, die coating, blade coating, curtain coating, wire bar coating, ring coating, and the like. Among them, dip coating is preferable from the viewpoint of efficiency and productivity.

In particular, a dip coating method of the charge generating layer and the charge transport layer will be described below.

It is preferable that a pulling speed in the dip coating is controlled such that the region from the central position of the image forming region to the end position of the image forming region in the axis direction of the photosensitive member is divided equally into five regions, and the average values of the film thicknesses in each of the regions obtained by being divided equally satisfies the definition in the present invention. In this case, for example, each pulling speed is set with respect to 10 points arranged in the axis direction of the photosensitive member, and a pulling speed between two adjacent points in the dip coating is smoothly changed, and thus, the control can be attained. At this time, it is not necessary that 10 points at which the pulling speed is set is divided equally in the axis direction of the photosensitive member. It is preferable a setting point of the pulling speed is selected such that a difference in the values of the pulling speed between two adjacent points is the same, from the viewpoint of the accuracy of controlling the film thickness of the charge generating layer and the charge transport layer.

[Process Cartridge and Electrophotographic Apparatus]

A process cartridge according to another aspect of the present invention integrally supports the electrophotographic photosensitive member according to one aspect of the present invention and at least one unit selected from the group consisting of a charging unit, a developing unit, a transfer unit, and a cleaning unit, and detachably attachable with respect to a main body of an electrophotographic apparatus.

In addition, an electrophotographic apparatus according to another aspect of the present invention includes the electrophotographic photosensitive member according to one aspect of the present invention, a charging unit, an exposing unit, a developing unit, and a transfer unit.

Figure 3:
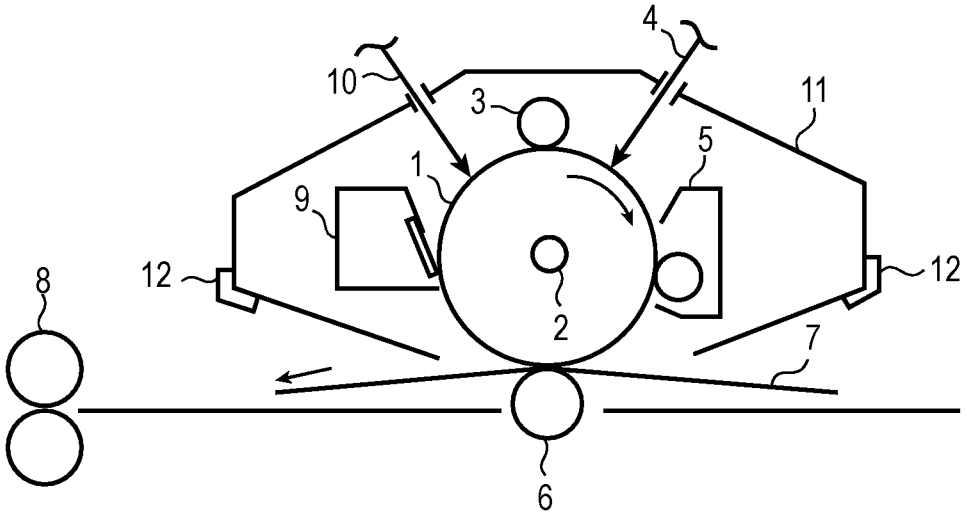
FIG. 3 is a diagram illustrating an example of an overview configuration of an electrophotographic apparatus provided with a process cartridge including the electrophotographic photosensitive member according to one aspect of the present invention.

FIG. 3 illustrates an example of an overview configuration of the electrophotographic apparatus including the process cartridge provided with electrophotographic photosensitive member.

A cylindrical electrophotographic photosensitive member is represented by 1, and is rotationally driven at a predetermined circumferential speed around an axis 2 in an arrow direction. The surface of the electrophotographic photosensitive member 1 is charged to a predetermined positive or negative potential by a charging unit 3. Note that, in the drawings, a roller charging method using a roller type charging member is illustrated, and a charging method such as a corona charging method, a proximity charging method, and an injection charging method may be adopted. The charged surface of the electrophotographic photosensitive member 1 is irradiated with exposure light 4 from an exposing unit (not illustrated), and an electrostatic latent image corresponding to target image information is formed. The electrostatic latent image formed on the surface of the electrophotographic photosensitive member 1 is developed by a toner contained in a developing unit 5, and a toner image is formed on the surface of the electrophotographic photosensitive member 1. The toner image formed on the surface of the electrophotographic photosensitive member 1 is transferred to a transfer material 7 by a transfer unit 6. The transfer material 7 to which the toner image is transferred is conveyed to a fixing unit 8, is subjected to a fixing treatment of the toner image, and is printed out to outside the electrophotographic apparatus. The electrophotographic apparatus may include a cleaning unit 9 for removing an attachment such as the toner remaining on the surface of the electrophotographic photosensitive member 1 after transfer. In addition, the cleaning unit 9 may not be separately provided, but a so-called cleanerless system may be used in which the attachment described above is removed by the developing unit 5 or the like. The electrophotographic apparatus may include a neutralization mechanism performing a neutralization treatment with respect to the surface of the electrophotographic photosensitive member 1 by pre-exposure light 10 of a pre-exposing unit (not illustrated). In addition, a guide unit 12 such as a rail may be provided such that the process cartridge 11 according to another aspect of the present invention is detachably attached to the main body of the electrophotographic apparatus.

The electrophotographic photosensitive member according to one aspect of the present invention can be used in a laser beam printer, an LED printer, a copier, a fax machine, a complex machine thereof, and the like.

Figure 4:
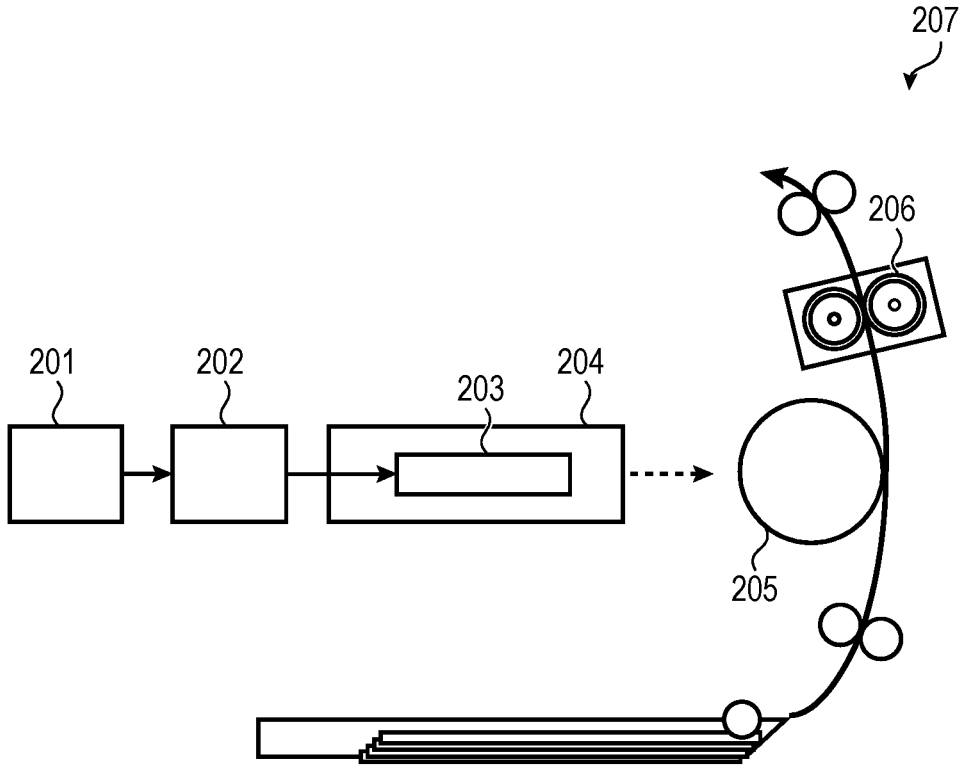
FIG. 4 is a diagram illustrating an example of an overview configuration of an exposing unit of the electrophotographic apparatus provided with the electrophotographic photosensitive member according to one aspect of the present invention.

FIG. 4 illustrates an example of an overview configuration 207 of the exposing unit of the electrophotographic apparatus provided with the electrophotographic photosensitive member according to one aspect of the present invention.

A laser driving unit 203 in a laser scanning apparatus 204 that is a laser scanning unit emits laser scanning light, on the basis of an image signal output from an image signal generating unit 201 and a control signal output from a control unit 202. A photosensitive member 205 that is charged by the charging unit (not illustrated) is scanned by laser light, and an electrostatic latent image is formed on the surface of the photosensitive member 205. A transfer material including a toner image that is obtained from the electrostatic latent image formed on the surface of the photosensitive member 205 is conveyed to a fixing unit 206, is subjected to a fixing treatment of the toner image, and then, is printed out to outside the electrophotographic apparatus.

Figure 5:
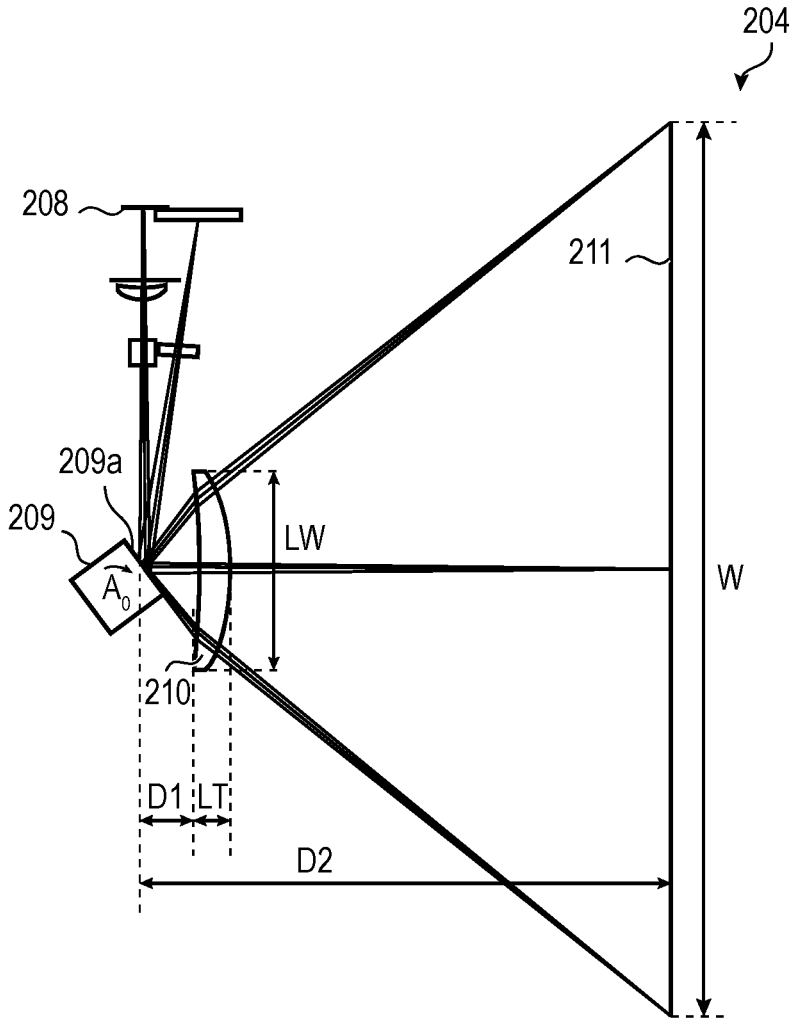
FIG. 5 is a cross-sectional view of a laser scanning apparatus of the electrophotographic apparatus provided with the electrophotographic photosensitive member according to one aspect of the present invention.

FIG. 5 is a cross-sectional view of the laser scanning apparatus 204 of the electrophotographic apparatus provided with the electrophotographic photosensitive member according to one aspect of the present invention.

Laser light (light flux) exiting from a laser light source 208 is transmitted through an optical system, and then, is reflected on a deflected surface (a reflected surface) 209*a* of polygon mirror (a deflector) 209, is transmitted through an imaging lens 210, and is incident on a scanned surface 211 of the photosensitive member surface. The imaging lens 210 is an imaging optical element. In the laser scanning apparatus 204, an imaging optical system includes only a single imaging optical element (the imaging lens 210). An image is formed on the scanned surface 211 of the photosensitive member surface on which the laser light is transmitted through the imaging lens 210, and a predetermined spot-like image (a spot) is formed. The polygon mirror 209 is rotated at a constant angular speed $A_0$ by a driving unit (not illustrated), and thus, the spot is moved in the axis direction of the photosensitive member on the scanned surface 211, and forms the electrostatic latent image on the scanned surface 211.

The imaging lens 210 does not have so-called fθ characteristics. That is, when the polygon mirror 209 is rotated at the constant angular speed $A_0$, scanning characteristics of moving the spot of the laser light transmitted through the imaging lens 210 at a constant speed on the scanned surface 211 is not provided. As described above, it is possible to dispose the imaging lens 210 close to the polygon mirror 209 (a position in which a distance D1 is small) by using the imaging lens 210 not having fθ characteristics. In addition, in the imaging lens 210 not having fθ characteristics, it is possible to decrease a width LW and a thickness LT, compared to an imaging lens having ID characteristics. As described above, the laser scanning apparatus 204 can be downsized. In addition, in the case of a lens having fθ characteristics, there may be a steep change in the shape of an incidence surface and an exit surface of the lens, and in a case where there is such restriction in the shape, there is a possibility that excellent imaging performance is not obtained. In contrast, the imaging lens 210 does not have fθ characteristics, and thus, there is no steep change in the shape of the incidence surface and the exit surface of the lens, and excellent imaging performance can be obtained.

The scanning characteristics of the imaging lens 210 not having fθ characteristics in which such an effect of decreasing the size or improving the imaging performance is obtained are represented by Expression (E3) described below.

$$Y = \frac{K}{B}\tan(B\theta) \tag{E3}$$

In Expression (E3), a scanning angle of the polygon mirror 209 is θ, and a light condensing position (an image height) of laser light in the axis direction of the photosensitive member on the scanned surface 211 is Y [mm]. In addition, an imaging coefficient in an on-axis image height is K [mm], a coefficient for determining the scanning characteristics of the imaging lens 210 (a scanning characteristic coefficient) is B. Note that, in the present invention, the on-axis image height indicates an image height on a light axis ($Y=0=Y_{min}$), and corresponds to the scanning angle θ=0. In addition, an off-axis image height indicates an image height (Y #0) on the outside from the central light axis (at the scanning angle θ=0), and corresponds to a scanning angle θ ≠0. Further, a maximum off-axis image height indicates an image height when the scanning angle θ is maximized ($Y=+Y'_{max}, -Y'_{max}$). Note that, a scanning width W that is the width of a predetermined region (a scanning region) in the axis direction of the photosensitive member, in which a latent image on the scanned surface 211 can be formed, is represented by $W=|+Y'_{max}|+|-Y'max|$. That is, a central position of the scanning region is the on-axis image height, and an end position is the maximum off-axis image height. In addition, the scanning region is larger than the image forming region of the photosensitive member.

Here, the imaging coefficient K is a coefficient corresponding to f in scanning characteristics Y=fθ in a case where the imaging lens 210 has the fθ characteristics. That is, in the imaging lens 210, the imaging coefficient K is a proportionality coefficient in a relational expression between the light condensing position Y and the scanning angle θ, as with the fθ characteristics.

In the supplement of the scanning characteristic coefficient, Expression (E3) at B=0 is Y=Kθ, and thus, corresponds to scanning characteristics Y=fθ of an imaging lens that is used in a light scanning apparatus of the related art. In addition, Expression (E3) at B=1 is Y=K·tan θ, and thus, corresponds to projection characteristics Y=f·tan θ of a lens that is used in an image pickup apparatus (a camera) or the like. That is, in Expression (E3), the scanning characteristic coefficient B is set in a range of 0≤B≤1, and thus, scanning characteristics between the projection characteristics Y=f·tan θ and the fθ characteristics Y=fθ can be obtained.

Here, in the case of differentiating Expression (E3) by the scanning angle θ, a scanning speed of laser light on the scanned surface 211 with respect to the scanning angle θ is obtained, as represented in Expression (E4) described below.

$$\frac{dY}{d\theta} = \frac{K}{\cos^2(B\theta)} \tag{E4}$$

Further, in the case of dividing Expression (E4) by a speed Y/θ=K in the on-axis image height, and of taking inverse numbers of both members, Expression (E5) described below is obtained.

$$\left(\frac{1}{K}\frac{dY}{d\theta}\right)^{-1} = \cos^2(B\theta) \tag{E5}$$

Expression (E5) represents a ratio of the inverse number of the scanning speed in each off-axis image height to the inverse number of the scanning speed in the on-axis image height. The total energy of laser light is constant regardless of the scanning angle θ, and thus, the inverse number of the scanning speed of the laser light on the scanned surface 211 of the photosensitive member surface is proportional to a laser light amount [μJ/cm$^2$] per unit area, which is applied to the position of the scanning angle θ. Therefore, Expression (E5) indicates a ratio of the laser light amount per unit area, which is applied to the scanned surface 211 at the scanning angle θ≠0, to the laser light amount per unit area, which is applied to the scanned surface 211 of the photosensitive member surface at the scanning angle θ=0. In the laser scanning apparatus 204, in the case of B≠0, the laser light amount per unit area, which is applied to the scanned surface 211, is different between the on-axis image height and the off-axis image height.

In a case where the distribution of the laser light amount as described above exists in the axis direction of the photosensitive member, the present invention having a sensitivity distribution in the axis direction of the photosensitive member can be preferably used. That is, in a case where the sensitivity distribution that exactly cancels the distribution of the laser light amount is attained by the configuration according to the present invention, the exposure potential distribution in the axis direction of the photosensitive member becomes homogeneous. The shape of the sensitivity distribution that is obtained at this time is represented by Expression (E6) described below, taking the inverse number of Expression (E5) described above.

$$\frac{1}{K}\frac{dY}{d\theta} = \frac{1}{\cos^2(B\theta)} \tag{E6}$$

In a case where the scanning angle corresponding to the end position of the image forming region of the photosensitive member is $\theta=\theta_{max}$, the value of Expression (E6) at $\theta=\theta_{max}$ indicates a sensitivity ratio r that is required for the photosensitive member when the laser scanning apparatus described above and the photosensitive member according to one aspect of the present invention are combined. Here, the sensitivity ratio r is a ratio of a photoelectric conversion efficiency of the end position of the image forming region to a photoelectric conversion efficiency of the central position of the image forming region. In a case where r is set, the geometric feature $\theta_{max}$ of the laser scanning apparatus and the scanning characteristic coefficient B of the optical system that are allowed to form a homogeneous exposure potential distribution in the axis direction of the photosensitive member, in image forming region, are set. Specifically, when the condition of Expression (E7) described below is satisfied, a homogeneous exposure potential distribution can be formed in the axis direction of the photosensitive member, in the image forming region of the photosensitive member according to one aspect of the present invention.

$$r = \frac{1}{\cos^2(B\theta_{max})} \tag{E7}$$

In the case of solving Expression (E7) described above with respect to $\theta_{max}$, Expression (E8) described below is obtained.

$$\theta_{max} = \frac{1}{B}\arccos\sqrt{r} \tag{E8}$$

Figure 6:
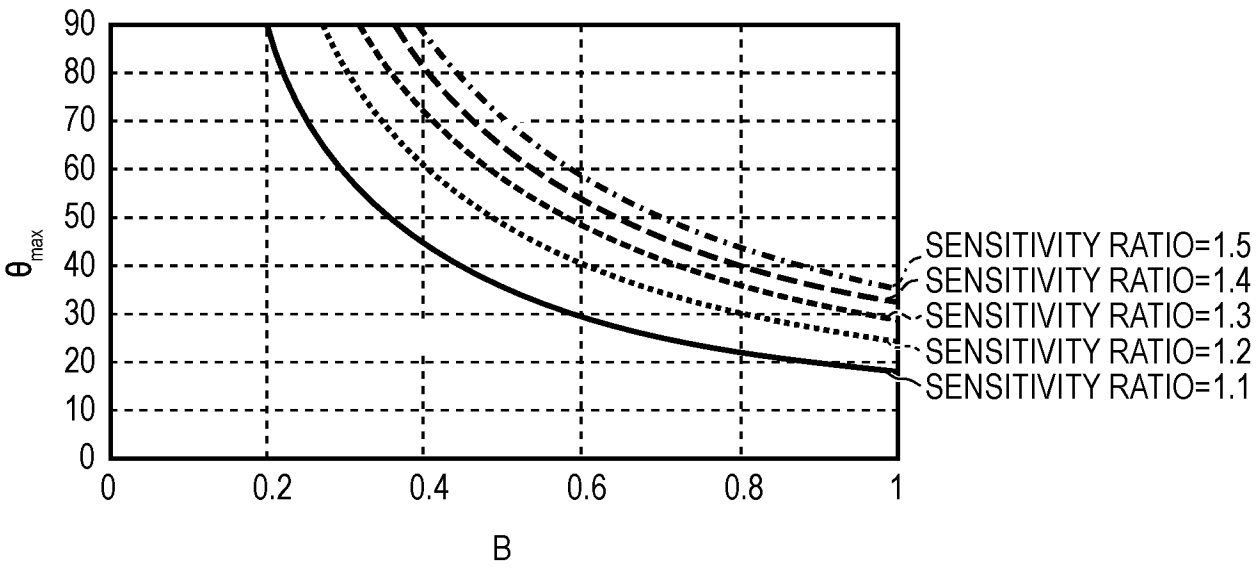
FIG. 6 is a graph showing a relationship in a sensitivity ratio in the image forming region of electrophotographic photosensitive member according to one aspect of the present invention, and a geometric feature $\theta_{max}$ of the laser scanning apparatus and a scanning characteristic coefficient B of an optical system.

FIG. 6 shows a graph of Expression (E8). As seen from FIG. 6, for example, in a case where the photosensitive member at r=1.2 and the imaging lens 210 at the scanning characteristic coefficient B=0.5 are combined, the laser scanning apparatus 204 may be designed such that $\theta_{max}$=48° is obtained. Accordingly, in the image forming region of the photosensitive member, the exposure potential distribution can be homogenized. On the other hand, for example, a case is considered in which the photosensitive member at r=1.1 and the imaging lens 210 at the scanning characteristic coefficient B=0.5 are combined. In this case, in a case where the laser scanning apparatus 204 is designed such that $\theta_{max}$=48° is obtained, in the image forming region of the photosensitive member, partial unevenness occurs in an exposure potential. At this time, in the image forming region of the photosensitive member, $\theta_{max}$=35° is required in order to homogenize the exposure potential distribution, and such a value is less than $\theta_{max}$=48°. Alight path length D2 from the deflected surface 209*a* to the scanned surface 211 of the photosensitive member surface, illustrated in FIG. 5, decreases as $\theta_{max}$ increases, and thus, it is possible to downsize the laser scanning apparatus 204. Therefore, as the sensitivity ratio r of the end position of the image forming region to the central position of the image forming region in the axis direction of the photosensitive member increases, it is possible to downsize the laser beam printer at the time of using the photosensitive member according to one aspect of the present invention.

Hereinafter, the support and each layer configuring the electrophotographic photosensitive member according to one aspect of the present invention will be described in detail.

<Support>

In the present invention, the electrophotographic photosensitive member includes the support. In the present invention, it is preferable that the support is an electro-conductive support having electro-conductivity. The support has a cylindrical shape. The surface of the support may be subjected to an electrochemical treatment such as anodic oxidization, blast processing, cutting processing, and the like.

A metal, a resin, glass, and the like are preferable as the material of the support.

Examples of the metal include aluminum, iron, nickel, copper, gold, stainless steel, an alloy thereof, and the like. Among them, an aluminum support using aluminum is preferable.

In addition, electro-conductivity may be imparted to the resin or the glass by a treatment in which the resin or the glass is mixed or covered with an electro-conductive material.

<Electroconductive Layer>

In the present invention, an electroconductive layer may be provided on the support. By providing the electroconductive layer, it is possible to suppress scratches or concavities and convexities on the surface of the support or to control light reflection on the surface of the support.

It is preferable that the electroconductive layer contains electro-conductive particles and a resin.

Examples of the material of the electro-conductive particles include a metal oxide, a metal, carbon black, and the like. Examples of the metal oxide include zinc oxide, aluminum oxide, indium oxide, silicon oxide, zirconium oxide, tin oxide, titanium oxide, magnesium oxide, antimony oxide, bismuth oxide, and the like. Examples of the metal include aluminum, nickel, iron, nichrome, copper, zinc, silver, and the like.

Among them, it is preferable to use a metal oxide as the electro-conductive particles, and in particular, it is more preferable to use titanium oxide, tin oxide, and zinc oxide.

In a case where the metal oxide is used as the electro-conductive particles, the surface of the metal oxide may be treated with a silane coupling agent or the like, or the metal oxide may be doped with an element such as phosphorus or aluminum or an oxide thereof.

In addition, the electro-conductive particles may have a laminated configuration including core particles, and a covering layer covering the particles. Examples of the core particles include titanium oxide, barium sulfate, zinc oxide, and the like. Examples of the covering layer include a metal oxide such as tin oxide.

In addition, in a case where the metal oxide is used as the electro-conductive particles, a volume average particle diameter thereof is preferably 1 nm or more and 500 nm or less, and is more preferably 3 nm or more and 400 nm or less.

Examples of the resin include a polyester resin, a polycarbonate resin, a polyvinyl acetal resin, an acryl resin, a silicone resin, an epoxy resin, a melamine resin, a polyurethane resin, a phenol resin, an alkyd resin, and the like.

In addition, the electroconductive layer may further contain a masking agent such as silicone oil, resin particles, and titanium oxide, and the like.

An average film thickness of the electroconductive layer is preferably 1 μm or more and 50 μm or less, and is more preferably 3 μm or more and 40 μm or less.

The electroconductive layer can be formed by preparing a coating liquid for an electroconductive layer containing each of the materials described above and a solvent, by forming a coated film thereof, and by drying the coated film. Examples of the solvent used in the coating liquid include an alcohol-based solvent, a sulfoxide-based solvent, a ketone-based solvent, an ether-based solvent, an ester-based solvent, an aromatic hydrocarbon-based solvent, and the like. In the coating liquid for an electroconductive layer, examples of a dispersion method for dispersing the electro-conductive particles include a method using a paint shaker, a sand mill, a ball mill, and a high-speed liquid collision disperser.

<Undercoat Layer>

In the present invention, an undercoat layer may be provided on the support or the electroconductive layer. By providing the undercoat layer, an adhesive function between layers can be improved, and a charge injection blocking function can be imparted.

It is preferable that the undercoat layer contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acryl resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, a cellulose resin, and the like.

Examples of the polymerizable functional group of the monomer having a polymerizable functional group include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, a carbon-carbon double bond group, and the like.

In addition, in order to increase electric characteristics, the undercoat layer may further contain an electron transport substance, a metal oxide, a metal, electro-conductive macromolecules, and the like. Among them, it is preferable to use an electron transport substance and a metal oxide.

Examples of the electron transport substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, a boron-containing compound, and the like. The undercoat layer may be formed as the cured film by using an electron transport substance having a polymerizable functional group, as the electron transport substance, and by copolymerizing the electron transport substance having a polymerizable functional group with the monomer having a polymerizable functional group described above.

Examples of the metal oxide include indium tin oxide, tin oxide, indium oxide, titanium oxide, zinc oxide, aluminum oxide, silicon dioxide, and the like. Examples of the metal include gold, silver, aluminum, and the like.

In addition, the undercoat layer may further contain additives.

An average film thickness of the undercoat layer is preferably 0.1 μm or more and 50 μm or less, is more preferably 0.2 μm or more and 40 μm or less, and is particularly preferably 0.3 μm or more and 30 μm or less.

The undercoat layer can be formed by preparing a coating liquid for an undercoat layer containing each of the materials described above and a solvent, by forming a coated film thereof, and by drying and/or curing the coated film. Examples of the solvent used in the coating liquid include an alcohol-based solvent, a ketone-based solvent, an ether-based solvent, an ester-based solvent, an aromatic hydrocarbon-based solvent, and the like.

<Photosensitive Layer>

The photosensitive layer includes a charge generating layer and a charge transport layer.

(1) Charge Generating Layer

It is preferable that the charge generating layer contains a charge generating substance and a binding resin for a charge generating layer.

Examples of the charge generating substance include an azo pigment, a perylene pigment, a polycyclic quinone pigment, an indigo pigment, a phthalocyanine pigment, and the like. Among them, it is preferable that the charge generating substance is a phthalocyanine pigment having a ghost suppressing effect. In the phthalocyanine pigment, an oxytitanium phthalocyanine pigment, a chlorogallium phthalocyanine pigment, and a hydroxygallium phthalocyanine pigment are preferable.

The content of the charge generating substance in the charge generating layer is preferably 40 mass % or more and 85 mass % or less, and is more preferably 60 mass % or more and 80 mass % or less, with respect to the total mass of the charge generating layer.

Examples of the binding resin for a charge generating layer include a polyester resin, a polycarbonate resin, a polyvinyl acetal resin, a polyvinyl butyral resin, an acryl resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, and the like. Among them, a polyvinyl butyral resin is more preferable.

It is preferable that a ratio of the charge generating substance to the binding resin for a charge generating layer is 1/5 or more and 5/1 or less, on a mass basis, from the viewpoint of suppressing the occurrence of the ghost.

In addition, the charge generating layer may further contain additives such as an antioxidant and an ultraviolet absorber. Specifically, a hindered phenol compound, a hindered amine compound, a sulfur compound, a phosphorus compound, a benzophenone compound, and the like are exemplified.

The charge generating layer can be formed by preparing a coating liquid for a charge generating layer containing each of the materials described above and a solvent, by forming a coated film thereof, and by drying the coated film. Examples of the solvent used in the coating liquid include an alcohol-based solvent, a sulfoxide-based solvent, a ketone-based solvent, an ether-based solvent, an ester-based solvent, an aromatic hydrocarbon-based solvent, and the like.

A film thickness distribution of the charge generating layer can be measured as follows.

First, the region from the central position of the image forming region to the end position of the image forming region in the axis direction of the cylindrical electrophotographic photosensitive member is divided equally into five regions. Next, each of the regions obtained by being divided equally is further divided equally into four regions in the axis direction and divided equally into eight regions in a circumferential direction, and thus, 32 partitions are obtained, and a film thickness of the charge generating layer is measured at an arbitrary measurement point in each of the partitions. Subsequently, in 32 partitions in each of the regions, average values of measurement values that are obtained are set as the average values of the film thicknesses of the charge generating layers in each of the regions, and are defined as $d_{11}$, $d_{12}$, $d_{13}$, $d_{14}$, and $d_{15}$ [μm] in the order from the central position of the image forming region toward the end position of the image forming region.

Note that, in the present invention, the central position of the image forming region indicates a position in the axis direction in which the image height Y in Expression (E3) described above is Y=0, up to 10% of the length of the image forming region in the axis direction is displaced in the axis direction, with respect to a center position of two regions divided equally from the image forming region in the axis direction of the photosensitive member.

In the film thickness distribution of the charge generating layer, when a light absorption coefficient of the charge generating layer is defined as β [$\mu m^{-1}$], it is preferable that a relationship between a film thickness $d_0$ [μm] of the charge generating layer in the central position of the image forming region and a film thickness $d_6$ [μm] of the charge generating layer in the end position of the image forming region satisfies Expression (E1) described below.

$$\frac{1-e^{-2\beta d_0}}{1-e^{-2\beta d_0}} \geq 1.2 \quad \text{(E1)}$$

Here, the light absorption coefficient β is defined by Lambert-Beer's law represented by Expression (E9) described below.

$$\frac{I}{I_0} = 1 - e^{-\beta d} \quad \text{(E9)}$$

Here, $I_0$ is the total energy of light that has been incident on a film having a film thickness d [μm], and I is the energy of light that is absorbed by the film having the film thickness d [μm]. In addition, $d_0$ and $d_6$ are the average value of the film thicknesses defined as follows. That is, first, a region having a width of $Y_{max}/20$ [mm] in the axis direction, which goes round in the circumferential direction, centering on each of the central position of the image forming region and the end position of the image forming region is considered. At this time, each of the regions is divided equally into four regions in the axis direction and divided equally into eight regions in the circumferential direction, and thus, 32 partitions are obtained, and the film thickness of the charge generating layer is measured at an arbitrary measurement point in each of the partitions. Subsequently, an average value of measurement values that are obtained is obtained for each of the regions, and the average values are defined as do and $d_6$, respectively.

As it is obvious from Expression (E9), a numerator on the left member of Expression (El) described above represents a light absorption rate of the end position of the image forming region, and a denominator on the left member represents a light absorption rate of the central position of the image forming region, respectively. Therefore, Expression (El) described above indicates that the end position of the image forming region has light absorption rate of 1.2 times or more that of the central position of the image forming region. Accordingly, in the image forming region in the axis direction of the photosensitive member, a sensitivity difference of at least 1.2 times can be provided, and thus, it is possible to flexibly handle a realistic deviation in the light amount distribution due to the downsizing of the optical system in a laser scanning system of the electrophotographic apparatus.

In addition, in Expression (E1), the reason of multiplying the exponent by 2 is because an exposure laser passing through the charge generating layer is reflected on the support side of the photosensitive member, and passes again through the charge generating layer.

(2) Charge Transport Layer

It is preferable that the charge transport layer contains a charge transport substance and a binding resin for a charge transport layer.

Examples of the charge transport substance include a polycyclic aromatic compound, a heterocyclic compound, a hydrazone compound, a styryl compound, an enamine compound, a benzidine compound, a triaryl amine compound, a resin having a group derived from such substances, and the like. Among them, a triaryl amine compound and a benzidine compound are preferable.

The content of the charge transport substance in the charge transport layer is preferably 25 mass % or more and 70 mass % or less, and is more preferably 30 mass % or more and 55 mass % or less, with respect to the total mass of the charge transport layer.

Examples of the binding resin for a charge transport layer include a polyester resin, a polycarbonate resin, an acryl resin, a polystyrene resin, and the like. Among them, a polycarbonate resin and a polyester resin are preferable. In particular, a polyacrylate resin is preferable as the polyester resin.

It is preferable that a ratio of the charge transport substance to the binding resin for a charge transport layer is 1/2 or more and 2/1 or less, a mass basis, from the viewpoint of suppressing the occurrence of the ghost. Note that, in the present invention, in a case where the electrophotographic photosensitive member includes a protection layer described below, it is preferable that the ratio of the charge transport substance to the binding resin is 1/2 or more and 2/1 or less, on a mass basis, with respect to a layer including the protection layer and the charge transport layer. Here, a binding resin includes both of the binding resin for a charge transport layer and a binding resin for a protection layer.

In addition, the charge transport layer may contain additives such as an antioxidant, an ultraviolet absorber, a plasticizer, a leveling agent, a sliding property imparting agent, and an abrasion resistance improver. Specifically, a hindered phenol compound, a hindered amine compound, a sulfur compound, a phosphorus compound, a benzophenone compound, a siloxane-modified resin, silicone oil, fluorine resin particles, polystyrene resin particles, polyethylene resin particles, silica particles, alumina particles, boron nitride particles, and the like are exemplified.

The charge transport layer can be formed by preparing a coating liquid for a charge transport layer containing each of the materials described above and a solvent, by forming a coated film thereof, and by drying the coated film. Examples of the solvent used in the coating liquid include an alcohol-based solvent, a ketone-based solvent, an ether-based solvent, an ester-based solvent, and an aromatic hydrocarbon-based solvent. Among such solvents, an ether-based solvent or an aromatic hydrocarbon-based solvent is preferable.

A film thickness distribution of the charge transport layer can be obtained as with the measurement of the film thickness distribution of the charge generating layer.

<Protection Layer>

In the present invention, the protection layer may be provided on the photosensitive layer. By providing the protection layer, it is possible to improve durability.

It is preferable that the protection layer contains electroconductive particles and/or a charge transport substance, and a binding resin for a protection layer.

Examples of the electro-conductive particles include particles of a metal oxide such as titanium oxide, zinc oxide, tin oxide, and indium oxide.

Examples of the charge transport substance include a polycyclic aromatic compound, a heterocyclic compound, a hydrazone compound, a styryl compound, an enamine compound, a benzidine compound, a triaryl amine compound, a resin having a group derived from such substances, and the like. Among them, a triaryl amine compound and a benzidine compound are preferable.

Examples of the binding resin for a protection layer include a polyester resin, an acryl resin, a phenoxy resin, a polycarbonate resin, a polystyrene resin, a phenol resin, a melamine resin, an epoxy resin, and the like. Among them, a polycarbonate resin, a polyester resin, and an acryl resin are preferable.

In addition, the protection layer may be formed as a cured film by polymerizing a composition containing a monomer having a polymerizable functional group. At this time, examples of a reaction include a heat polymerization reaction, a photopolymerization reaction, a radiation polymerization reaction, and the like. Examples of the polymerizable functional group of the monomer having a polymerizable functional group include an acryl group, a methacryl group, and the like. A material having charge transport capacity may be used as the monomer having a polymerizable functional group.

The protection layer may contain additives such as an antioxidant, an ultraviolet absorber, a plasticizer, a leveling agent, a sliding property imparting agent, and an abrasion resistance improver. Specifically, a hindered phenol compound, a hindered amine compound, a sulfur compound, a phosphorus compound, a benzophenone compound, a siloxane-modified resin, silicone oil, fluorine resin particles, polystyrene resin particles, polyethylene resin particles, silica particles, alumina particles, boron nitride particles, and the like are exemplified.

The protection layer can be formed by preparing a coating liquid for a protection layer containing each of the materials described above and a solvent, by forming a coated film thereof, and by drying and/or curing the coated film. Examples of the solvent used in the coating liquid include an alcohol-based solvent, a ketone-based solvent, an ether-based solvent, a sulfoxide-based solvent, an ester-based solvent, and an aromatic hydrocarbon-based solvent.

EXAMPLES

Hereinafter, the present invention will be described in more detail, by using examples and comparative examples. The present invention is not limited to the following examples unless exceeding the gist thereof. Note that, in the description of the following examples, "part" is on a mass basis, unless otherwise particularly noted.

Example 1

An aluminum cylinder (JIS-A3003, an aluminum alloy) having a length of 260.5 mm and a diameter of 30 mm was set to a support (an electro-conductive support).

Subsequently, the following materials were prepared.

- 214 Parts of Titanium Oxide ($TiO_2$) Particles (Number Average Primary Particle Diameter of 200 nm) Covered with Oxygen Defect Tin Oxide ($SnO_2$) as Metal Oxide Particles
- 132 Parts of Phenol Resin (Product Name: Priophene J-325) as Binding Resin
- 40 Parts of Methanol
- 58 Parts of 1-Methoxy-2-Propanol These materials were put in a sand mill using 450 parts of glass beads having a diameter of 0.8 mm, were subjected to a dispersion treatment in a condition of Number of Rotations: 2000 rpm, Dispersion Treatment Time: 4.5 hours, and Setting Temperature of Cooling Water: 18° C., and thus, a dispersion liquid was obtained. The glass beads were removed from the dispersion liquid by a mesh (Aperture: 150 μm). The following materials were added to the dispersion liquid at the following ratio with respect to a total mass of the metal oxide particles and the binding resin in the dispersion liquid after the glass beads were removed.

- Silicone Oil (SH28PA, manufactured by Dow Corning Toray Co., Ltd.) as Leveling Agent: 0.01 mass %
- Silicone Resin Particles (Tospearl 120, manufactured by Momentive Performance Materials Japan LLC): 15 mass %

A dispersion liquid obtained as described above was stirred, and thus, a coating liquid for an electroconductive layer was prepared. The coating liquid for an electroconductive layer was subjected to dip coating on the support, and a coated film that was obtained was subjected to drying and thermal curing at 160° C. for 60 minutes, and thus, an electroconductive layer having a film thickness of 30.2 μm was formed.

After that, the following materials were prepared.

4.5 Parts of N-Methoxymethylated Nylon (Product Name: Tresin EF-30T, Manufactured by Nagase ChemteX Corporation (Former Teikoku Kagaku Sangyo K.K.)

1.5 Parts of Copolymerization Nylon Resin (Product Name: Amilan CM8000, Manufactured by TORAY INDUSTRIES, INC.)

These materials were dissolved in a mixed solvent of 65 parts of methanol/30 parts of n-butanol, and thus, a coating liquid for an undercoat layer was prepared. The coating liquid for an undercoat layer was subjected to dip coating on the electroconductive layer, and was dried at 70° C. for 6 minutes, and thus, an undercoat layer having a film thickness of 0.4 μm was formed.

Next, the following materials were prepared.

10 Parts of Hydroxygallium Phthalocyanine Crystals (Charge Generating Substance, Having Peak at Bragg Angles (2θ±0.2°) of 7.5°, 9.9°, 12.5°, 16.3°, 18.6°, 25.1°, and 28.3° in CuKα Characteristic X-Ray Diffraction)

5 Parts of Polyacetal Resin (Product Name: S-LEC BX-1, Manufactured by SEKISUI CHEMICAL CO., LTD.)

250 Parts of Cyclohexanone

These materials were put in a sand mill using glass beads having a diameter of 1 mm, and were subjected to a dispersion treatment for 1.5 hours. Next, 250 parts of ethyl acetate was added thereto, and thus, a coating liquid for a charge generating layer was prepared. The coating liquid for a charge generating layer was applied onto the undercoat layer by dip coating while a pulling speed was changed, and a coated film that was obtained was dried at 100° C. for 10 minutes, and thus, a charge generating layer was formed.

Next, the following materials were prepared.

7 Parts of Amine Compound Represented by Expression (1) Described below as Charge Transport Substance 10 Parts of Polyester Resin Having Structural Unit Expression (2) Described below and Expression (3) Described below, Molar Ratio of Structural Unit Represented by Expression (2) Described below and Structural Unit Represented by Expression (3) Described below of 5/5, and Weight Average Molecular Weight of 120,000

These materials were dissolved in a mixed solvent of 50 parts of dimethoxymethane and 50 parts of O-xylene, and thus, a coating liquid for a charge transport layer was prepared. The coating liquid for a charge transport layer was applied onto the charge generating layer by dip coating while a pulling speed was changed, and a coated film that was obtained was dried at 120° C. for 20 minutes, and thus, a charge transport layer was formed.

(1)

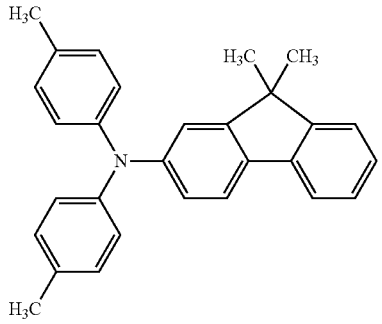

-continued (2)

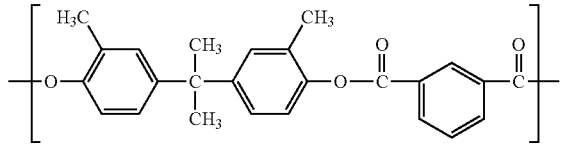

(3)

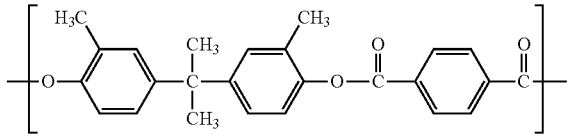

A film thickness of the charge generating layer was precisely and simply measured as follows.

First, a calibration curve was acquired from a Macbeth concentration value that was measured by pressing a spectroscopic concentration meter (Product Name: X-Rite 504/508, manufactured by X-Rite, Incorporated) against the surface of a photosensitive member and a measurement value of a film thickness that was obtained by observing a sectional SEM image. Subsequently, the Macbeth concentration value at a measurement point of the photosensitive member was converted by using the calibration curve, and thus, a film thickness at each measurement point of the charge generating layer was obtained.

A film thickness of the charge transport layer was obtained measured by using a laser interference film thickness meter (Product Name: SI-T80, manufactured by KEYENCE CORPORATION).

Average values $d_{11}$, $d_{12}$, $d_{13}$, $d_{14}$, and $d_{15}$ of the film thicknesses of the charge generating layer that are obtained and average values $d_{21}$, $d_{22}$, $d_{23}$, $d_{24}$, and $d_{25}$ of the film thicknesses of the charge transport layer that are obtained are shown in Table 1. In addition, five values of $d_{11}\times d_{21}$, $d_{12}\times d_{22}$, $d_{13}\times d_{23}$, $d_{14}\times d_{24}$, and $d_{15}\times d_{25}$ that are calculated from the average values of the film thicknesses of each of the layers, and a standard deviation of five values are shown in Table 2. Further, a value that is calculated from Expression (E1), a mass ratio between the charge generating substance and the binding resin for a charge generating layer, and a mass ratio between the charge transport substance and the binding resin for a charge transport layer are shown in Table 2.

[Evaluation]

A laser beam printer manufactured by Hewlett Packard Enterprise Development LP (Product Name: Color Laser Jet CP3525dn) was prepared as an electrophotographic apparatus for evaluation, and was modified as follows.

First, charging was set by using an external power source such that Vpp of AC was 1800 V, a frequency was 870 Hz, and an applied voltage of DC was −500 V. Subsequently, a laser beam printer that was modified such that a scanning characteristic coefficient B and a geometric feature $\theta_{max}$ of a laser scanning apparatus in Expression (E8) were B=0.55 and $\theta_{max}$=45° was prepared as an optical system, in addition to a default machine that was not changed at all.

In addition, the laser beam printer was operated in a state where a pre-exposure condition, a charging condition, and a laser exposure amount were variable.

In an environment of a temperature of 22.5° C. and humidity of 50% RH, the electrophotographic photosensitive member manufactured in Example 1 described above was mounted on a cyan process cartridge, the cyan process cartridge was mounted on a station of the cyan process cartridge and thus, image evaluation was performed. At this time, the laser beam printer was operated without mounting process cartridges for other colors (magenta, yellow, and black) in the main body of the laser beam printer.

When an image was output, only the cyan process cartridge was attached to the main body of the laser beam printer, and thus, a monochromatic image using only a cyan toner was output.

A surface potential of the electrophotographic photosensitive member was set such that the potential of an initial dark portion in a central position of an image forming region was −500 V, and the potential of an initial bright portion was −120 V.

The surface potential of the electrophotographic photosensitive member was measured by modifying a cartridge, by mounting a potential probe (Model 6000B-8, manufactured by TREK JAPAN) in a developing position, and by using a surface potential meter (Model 344, manufactured by TREK JAPAN). The surface potential was measured in a central position in an axis direction of the electrophotographic photosensitive member.

Figure 7:
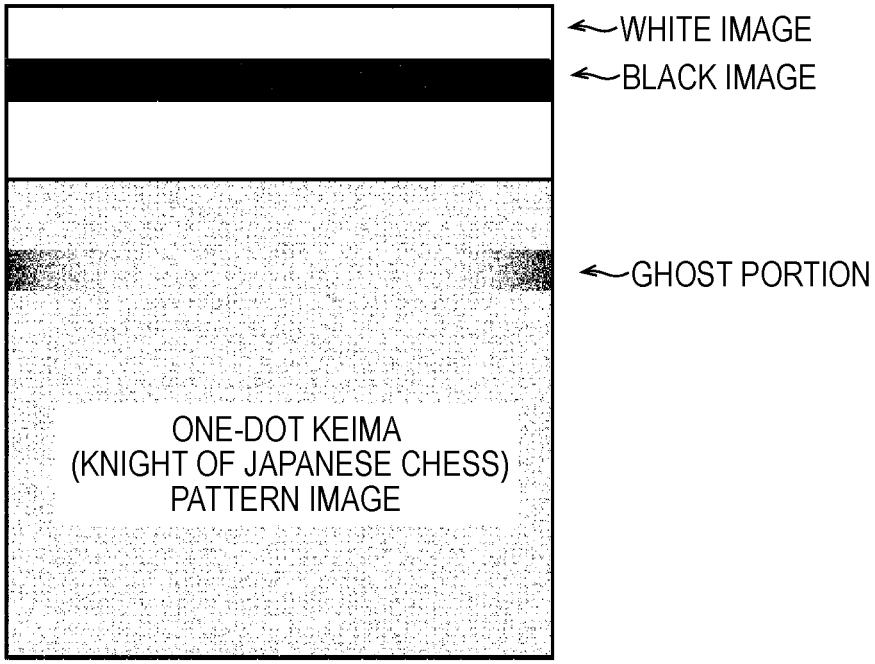
FIG. 7 is a diagram illustrating printing for ghost evaluation used in examples.
Figure 8:
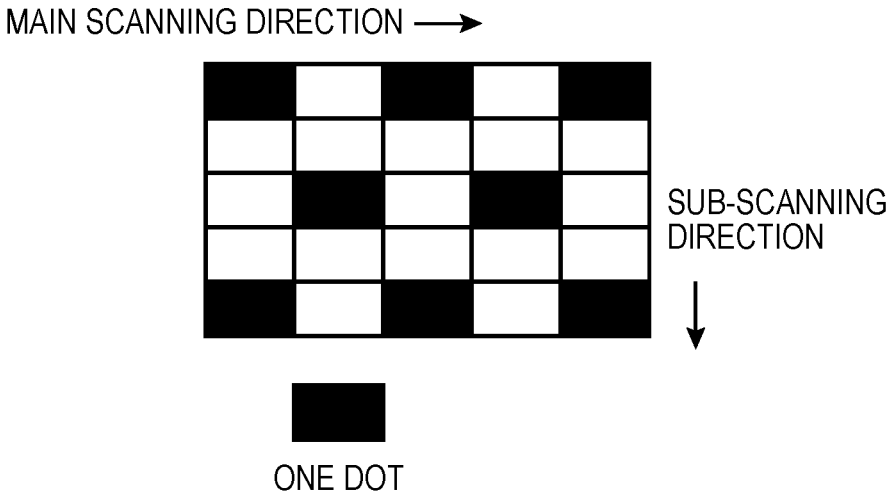
FIG. 8 is a diagram illustrating a halftone image of one-dot Keima (knight of Japanese chess) patterns used in the examples.

Subsequently, one white solid image was output as the first sheet without turning on pre-exposure, by using the electrophotographic apparatus for evaluation described above. After that, printing for ghost evaluation was performed. That is, as illustrated in FIG. 7, five continuous images having a halftone image of one-dot Keima (knight of Japanese chess) patterns illustrated in FIG. 8 were continuously output, subsequent to an image having a black background (a black image) in a white background (a white image) in a head portion of the image. In FIG. 7, a portion described as "Ghost Portion" is a portion in which the presence or absence of the appearance of ghost due to a solid image is evaluated.

(Ghost Evaluation)

In ghost evaluation, a concentration difference between an image concentration of the halftone image of the one-dot Keima (knight of Japanese chess) patterns and an image concentration of the ghost portion, in the printing for ghost evaluation, was measured by a spectroscopic concentration meter (Product Name: X-Rite504/508, manufactured by X-Rite, Incorporated). When a region from the central position of the image forming region to the end position of the image forming region was divided equally into five regions, the ghost evaluation was performed with respect to an image region corresponding to each of the regions obtained by being divided equally. In each of the halftone image and the ghost portion in the printing for ghost evaluation, image concentrations at 10 points in each of the regions obtained by being divided equally were measured, and the average of 10 points was calculated. Such evaluation was similarly performed with respect to five images in the printing for ghost evaluation described above. A concentration difference between an average value of the image concentrations with respect to the halftone image and an average value of the image concentrations with respect to the ghost portion was a ghost image concentration difference. An effect of suppressing the occurrence of a ghost image increases as the value of the ghost image concentration difference decreases. The ghost evaluation was performed on the basis of the following criteria. A represents that the ghost image concentration difference is less than 0.01, B represents that the ghost image concentration difference is 0.01 or more and less than 0.02, C represents that the ghost image concentration difference is 0.02 or more and less than 0.03, D represents that the ghost image concentration difference is 0.03 or more and less than 0.04, and E represents that the ghost image concentration difference is 0.04 or more.

Evaluation Results are Shown in Table 3.

In the present invention, in a case where the evaluation result in each of the regions when the region from the central position of the image forming region to the end position of the image forming region was divided equally into five regions was A, B, or C, it was determined that the effect of the present invention was obtained. In particular, a case where the evaluation result was A in all of the regions was determined as excellent. On the other hand, in a case where the evaluation result was D or E in any region, it was determined that the effect of the present invention was not obtained.

In addition, a case where the evaluation result in each of the regions was A, B, or C, but there was small unevenness in a concentration difference in the ghost images in each of the regions was determined as more excellent. The unevenness in the concentration difference in the ghost images was evaluated by calculating a difference between a maximum concentration and a minimum concentration of each of the average values of the measured image concentrations at 10 point in the halftone image. An effect of preventing the ghost image from being visually noticeable increases as the concentration difference decreases. The concentration difference was evaluated on the basis of the following criteria. a represents that the concentration difference is less than 0.005, b represents that the concentration difference is 0.005 or more and less than 0.015, c represents that the concentration difference is 0.015 or more and less than 0.025, and d represents that the concentration difference is 0.025 or more and less than 0.035.

Evaluation results are shown in Table 3.

Examples 2 to 22

In Example 1, the film thicknesses of the charge generating layer and the charge transport layer were set to values shown in Table 1, by changing the pulling speed in the dip coating. An electrophotographic photosensitive member was manufactured as with Example 1 except for the above, and ghost evaluation was similarly performed. Each characteristic of the obtained electrophotographic photosensitive member is shown in Table 2, and the results of the ghost evaluation are shown in Table 3.

Example 23

In Example 1, the content of the charge transport substance that was used for forming the charge transport layer was changed to 5 parts from 7 parts, and the content of the polyester resin was changed to 11 parts from 10 parts. An electrophotographic photosensitive member was manufactured as with Example 1 except for the above, and ghost evaluation was similarly performed. Each characteristic of the obtained electrophotographic photosensitive member is shown in Table 2, and the results of the ghost evaluation are shown in Table 3.

Example 24

In Example 1, the content of the charge transport substance that was used for forming the charge transport layer was changed to 19 parts from 7 parts, and the content of the polyester resin was changed to 9 parts from 10 parts. An electrophotographic photosensitive member was manufactured as with Example 1 except for the above, and ghost evaluation was similarly performed. Each characteristic of the obtained electrophotographic photosensitive member is shown in Table 2, and the results of the ghost evaluation are shown in Table 3.

Example 25

An electrophotographic photosensitive member was manufactured as with Example 1, except that the charge generating layer was formed as follows.

In 150 parts of cyclohexanone, 15 parts of a butyral resin (S-LEC BLS, manufactured by SEKISUI CHEMICAL CO., LTD.) was dissolved, and 10 parts of a trisazo pigment represented by Expression (4) described below was added thereto, and dispersion was performed for 48 hours by a ball mill.

First, the following materials were prepared.

10 Parts of Oxytitanium Phthalocyanine Having Strong Peak at Bragg Angles (20±0.2°) of 9.0°, 14.2°, 23.9°, and 27.1° in X-Ray Diffraction of CuKα

166 Parts of Polyvinyl Butyral Resin (Product Name: S-LEC BX-1, manufactured by SEKISUI CHEMICAL CO., LTD.) Dissolved in Mixed Solvent of Cyclohexanone:Water=97:3 to Be Solution of 5 Mass %

This was mixed with 150 parts of the mixed solvent of Cyclohexanone: Water=97:3, and was dispersed with 400 parts of 1 mmφ glass beads for 4 hours by a sand mill apparatus. After that, 210 parts of the mixed solvent of Cyclohexanone: Water=97:3 and 260 parts of cyclohexanone were further added thereto, and thus, a coating liquid for a charge generating layer was prepared. The coating liquid for a charge generating layer was applied onto the undercoat layer by dip coating while a pulling speed was changed, and a coated film that was obtained was dried at (4)

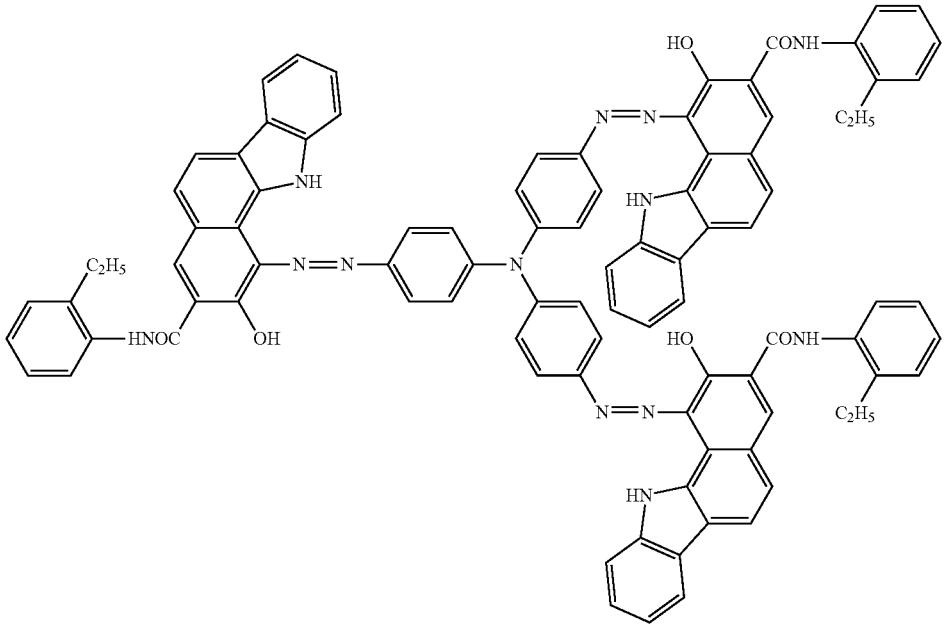

Subsequently, 210 parts of cyclohexanone was added, and dispersion was performed for 3 hours. This was diluted with cyclohexanone while being stirred such that a solid content was 1.5%, and thus, a coating liquid for a charge generating layer was prepared. A charge generating layer was formed on the undercoat layer with the coating liquid for a charge generating layer by dip coating while a pulling speed was changed. The film thicknesses of the charge generating layer and the charge transport layer of the obtained electrophotographic photosensitive member are shown in Table 1. In addition, each characteristic of the obtained electrophotographic photosensitive member is shown in Table 2. In the obtained electrophotographic photosensitive member, ghost evaluation was performed as with Example 1. Evaluation results are shown in Table 3.

Example 26

An electrophotographic photosensitive member was manufactured as with Example 1, except that the charge generating layer was formed as follows.

100° C. for 10 minutes, and thus, a charge generating layer was formed. The film thicknesses of the charge generating layer and the charge transport layer of the obtained electrophotographic photosensitive member are shown in Table 1. In addition, each characteristic of the obtained electrophotographic photosensitive member is shown in Table 2.

In the obtained electrophotographic photosensitive member, ghost evaluation was performed as with Example 1. Evaluation results are shown in Table 3.

Comparative Example 1

In Example 24, the film thickness of the charge transport layer was formed as shown in Table 1. An electrophotographic photosensitive member was manufactured as with Example 24 except for the above, and ghost evaluation was performed as with Example 1. Each characteristic of the obtained electrophotographic photosensitive member is shown in Table 2, and the results of the ghost evaluation are shown in Table 3.

TABLE 1

| | Film thickness (μm) of charge generating layer | | | | | | | Film thickness (μm) of charge transport layer | | | | |
|---|---|---|---|---|---|---|---|---|---|---|---|---|
| | d11 | d12 | d13 | d14 | d15 | d0 | d6 | d21 | d22 | d23 | d24 | d25 |
| Example 1 | 0.102 | 0.107 | 0.121 | 0.145 | 0.185 | 0.101 | 0.198 | 25 | 24 | 21 | 16 | 14 |
| Example 2 | 0.102 | 0.107 | 0.121 | 0.145 | 0.185 | 0.101 | 0.198 | 25 | 23 | 21 | 19 | 17 |
| Example 3 | 0.102 | 0.107 | 0.121 | 0.145 | 0.185 | 0.101 | 0.198 | 23 | 22 | 21 | 20 | 19 |
| Example 4 | 0.102 | 0.107 | 0.121 | 0.145 | 0.185 | 0.101 | 0.198 | 20 | 19 | 17 | 15 | 12 |
| Example 5 | 0.102 | 0.107 | 0.121 | 0.145 | 0.185 | 0.101 | 0.198 | 20 | 17.5 | 15 | 13 | 10 |
| Example 6 | 0.102 | 0.107 | 0.121 | 0.145 | 0.185 | 0.101 | 0.198 | 15 | 14 | 13 | 12 | 11 |
| Example 7 | 0.102 | 0.107 | 0.121 | 0.145 | 0.185 | 0.101 | 0.198 | 15 | 13 | 11 | 9 | 7 |
| Example 8 | 0.082 | 0.093 | 0.115 | 0.153 | 0.212 | 0.080 | 0.226 | 25 | 21 | 17 | 13 | 10 |
| Example 9 | 0.082 | 0.093 | 0.115 | 0.153 | 0.212 | 0.080 | 0.226 | 20 | 18 | 16 | 14 | 12 |
| Example 10 | 0.082 | 0.093 | 0.115 | 0.153 | 0.212 | 0.080 | 0.226 | 15 | 14 | 12 | 10 | 7 |
| Example 11 | 0.082 | 0.093 | 0.115 | 0.153 | 0.212 | 0.080 | 0.226 | 12 | 11 | 10 | 9 | 8 |
| Example 12 | 0.115 | 0.122 | 0.131 | 0.162 | 0.187 | 0.110 | 0.210 | 25 | 22 | 19 | 16 | 13 |
| Example 13 | 0.115 | 0.122 | 0.131 | 0.162 | 0.187 | 0.110 | 0.210 | 24 | 20 | 16 | 12 | 8 |
| Example 14 | 0.115 | 0.122 | 0.131 | 0.162 | 0.187 | 0.110 | 0.210 | 15 | 13 | 11 | 9 | 7 |
| Example 15 | 0.115 | 0.122 | 0.131 | 0.162 | 0.187 | 0.110 | 0.210 | 18 | 15 | 12 | 9 | 6 |
| Example 16 | 0.095 | 0.105 | 0.120 | 0.132 | 0.141 | 0.090 | 0.150 | 25 | 24 | 23 | 22 | 21 |
| Example 17 | 0.115 | 0.120 | 0.130 | 0.140 | 0.150 | 0.110 | 0.155 | 25 | 24 | 23 | 22 | 21 |
| Example 18 | 0.100 | 0.130 | 0.150 | 0.170 | 0.190 | 0.095 | 0.200 | 24 | 23 | 22 | 21 | 20 |
| Example 19 | 0.100 | 0.150 | 0.190 | 0.220 | 0.250 | 0.090 | 0.260 | 20 | 17 | 15 | 12 | 8 |
| Example 20 | 0.080 | 0.109 | 0.155 | 0.204 | 0.300 | 0.080 | 0.320 | 35 | 25 | 18 | 13 | 10 |
| Example 21 | 0.134 | 0.142 | 0.156 | 0.198 | 0.280 | 0.130 | 0.290 | 23 | 22 | 21 | 16 | 12 |
| Example 22 | 0.162 | 0.165 | 0.174 | 0.217 | 0.287 | 0.160 | 0.335 | 15 | 14 | 13 | 12 | 11 |
| Example 23 | 0.102 | 0.107 | 0.121 | 0.145 | 0.185 | 0.100 | 0.200 | 25 | 21 | 17 | 13 | 10 |
| Example 24 | 0.102 | 0.107 | 0.121 | 0.145 | 0.185 | 0.100 | 0.200 | 25 | 21 | 17 | 13 | 10 |
| Example 25 | 0.155 | 0.160 | 0.165 | 0.170 | 0.175 | 0.150 | 0.180 | 24 | 23 | 22 | 21 | 20 |
| Example 26 | 0.105 | 0.125 | 0.150 | 0.175 | 0.220 | 0.100 | 0.150 | 25 | 21 | 17 | 13 | 10 |
| Comparative Example 1 | 0.155 | 0.160 | 0.180 | 0.190 | 0.200 | 0.150 | 0.220 | 23 | 23 | 23 | 23 | 23 |

TABLE 2

| | $d_{11} \times d_{21}$ | $d_{12} \times d_{22}$ | $d_{13} \times d_{23}$ | $d_{14} \times d_{24}$ | $d_{15} \times d_{25}$ | Standard deviation | β ($\mu m^{-1}$) | Expression (E1) | Charge generating substance/ binding resin (mass ratio) | Charge transport substance/ binding resin (mass ratio) |
|---|---|---|---|---|---|---|---|---|---|---|
| Example 1 | 2.6 | 2.6 | 2.5 | 2.3 | 2.6 | 0.10 | 5.0 | 1.36 | 10/5 | 7/10 |
| Example 2 | 2.6 | 2.5 | 2.5 | 2.8 | 3.1 | 0.25 | 5.0 | 1.36 | 10/5 | 7/10 |
| Example 3 | 2.3 | 2.4 | 2.5 | 2.9 | 3.5 | 0.44 | 5.0 | 1.36 | 10/5 | 7/10 |
| Example 4 | 2.0 | 2.0 | 2.1 | 2.2 | 2.2 | 0.08 | 5.0 | 1.36 | 10/5 | 7/10 |
| Example 5 | 2.0 | 1.9 | 1.8 | 1.9 | 1.9 | 0.08 | 5.0 | 1.36 | 10/5 | 7/10 |
| Example 6 | 1.5 | 1.5 | 1.6 | 1.7 | 2.0 | 0.20 | 5.0 | 1.36 | 10/5 | 7/10 |
| Example 7 | 1.5 | 1.4 | 1.3 | 1.3 | 1.3 | 0.09 | 5.0 | 1.36 | 10/5 | 7/10 |
| Example 8 | 2.1 | 2.0 | 2.0 | 2.0 | 2.1 | 0.06 | 5.0 | 1.63 | 10/5 | 7/10 |
| Example 9 | 1.6 | 1.7 | 1.8 | 2.1 | 2.5 | 0.34 | 5.0 | 1.63 | 10/5 | 7/10 |
| Example 10 | 1.2 | 1.3 | 1.4 | 1.5 | 1.5 | 0.11 | 5.0 | 1.63 | 10/5 | 7/10 |
| Example 11 | 1.0 | 1.0 | 1.2 | 1.4 | 1.7 | 0.26 | 5.0 | 1.63 | 10/5 | 7/10 |
| Example 12 | 2.9 | 2.7 | 2.5 | 2.6 | 2.4 | 0.16 | 5.0 | 1.32 | 10/5 | 7/10 |
| Example 13 | 2.8 | 2.4 | 2.1 | 1.9 | 1.5 | 0.43 | 5.0 | 1.32 | 10/5 | 7/10 |
| Example 14 | 1.7 | 1.6 | 1.4 | 1.5 | 1.3 | 0.14 | 5.0 | 1.32 | 10/5 | 7/10 |
| Example 15 | 2.1 | 1.8 | 1.6 | 1.5 | 1.1 | 0.32 | 5.0 | 1.32 | 10/5 | 7/10 |
| Example 16 | 2.4 | 2.5 | 2.8 | 2.9 | 3.0 | 0.22 | 5.0 | 1.31 | 10/5 | 7/10 |
| Example 17 | 2.9 | 2.9 | 3.0 | 3.1 | 3.2 | 0.11 | 5.0 | 1.18 | 10/5 | 7/10 |
| Example 18 | 2.4 | 3.0 | 3.3 | 3.6 | 3.8 | 0.49 | 5.0 | 1.41 | 10/5 | 7/10 |
| Example 19 | 2.0 | 2.6 | 2.9 | 2.6 | 2.0 | 0.35 | 5.0 | 1.56 | 10/5 | 7/10 |
| Example 20 | 2.8 | 2.7 | 2.8 | 2.7 | 3.0 | 0.12 | 5.0 | 1.74 | 10/5 | 7/10 |
| Example 21 | 3.1 | 3.1 | 3.3 | 3.2 | 3.4 | 0.10 | 5.0 | 1.30 | 10/5 | 7/10 |
| Example 22 | 2.4 | 2.3 | 2.3 | 2.6 | 3.2 | 0.32 | 5.0 | 1.21 | 10/5 | 7/10 |
| Example 23 | 2.6 | 2.2 | 2.1 | 1.9 | 1.9 | 0.26 | 5.0 | 1.37 | 10/5 | 5/11 |
| Example 24 | 2.6 | 2.2 | 2.1 | 1.9 | 1.9 | 0.26 | 5.0 | 1.37 | 10/5 | 19/9 |
| Example 25 | 3.7 | 3.7 | 3.6 | 3.6 | 3.5 | 0.08 | 1.0 | 1.17 | 10/15 | 7/10 |
| Example 26 | 2.6 | 2.6 | 2.6 | 2.3 | 2.2 | 0.18 | 5.4 | 1.21 | 10/8.3 | 7/10 |
| Comparative Example 1 | 3.6 | 3.7 | 4.1 | 4.4 | 4.6 | 0.40 | 1.0 | 1.37 | 10/5 | 7/10 |

TABLE 3

| | Evaluation of ghost image in each region | | | | | |
|---|---|---|---|---|---|---|
| | d11, d21 | d12, d22 | d13, d23 | d14, d24 | d15, d25 | Region unevenness |
| Example 1 | A | A | A | A | A | a |
| Example 2 | A | A | A | A | B | b |
| Example 3 | A | A | A | A | C | d |
| Example 4 | A | A | A | A | A | a |
| Example 5 | A | A | A | A | A | a |
| Example 6 | A | A | A | A | A | a |
| Example 7 | A | A | A | A | A | a |
| Example 8 | A | A | A | A | A | a |
| Example 9 | A | A | A | A | A | c |
| Example 10 | A | A | A | A | A | a |
| Example 11 | B | A | A | A | A | b |
| Example 12 | A | A | A | A | A | a |
| Example 13 | A | A | A | A | A | d |
| Example 14 | A | A | A | A | A | a |
| Example 15 | A | A | A | A | A | c |
| Example 16 | A | A | A | A | A | b |
| Example 17 | A | A | A | C | C | b |
| Example 18 | A | A | B | C | C | d |
| Example 19 | A | A | A | A | A | c |
| Example 20 | A | A | A | A | A | a |
| Example 21 | B | B | B | B | B | a |
| Example 22 | A | A | A | A | B | c |
| Example 23 | A | A | A | A | A | b |
| Example 24 | A | A | A | A | A | b |
| Example 25 | C | C | C | C | C | b |
| Example 26 | A | A | A | A | A | a |
| Comparative Example 1 | C | C | D | D | E | d |

As described above by using the embodiments and examples, according to the present invention, it is possible to provide an electrophotographic photosensitive member in which a suitable sensitivity distribution is provided in the photosensitive member in an axis direction, and a ghost phenomenon on an end portion of the photosensitive member in the axis direction is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-117811, filed Jun. 25, 2019, which is hereby incorporated by reference herein in its entirety.

What is claimed is:

1. An electrophotographic photosensitive member, comprising:

a cylindrical support;

a charge generating layer formed on the cylindrical support; and a charge transport layer formed on the charge generating layer, wherein $d_{11}<d_{12}<d_{13}<d_{14}<d_{15}$ where $d_{11}$, $d_{12}$, $d_{13}$, $d_{14}$ and $d_{15}$ are respectively average film thicknesses (μm) of the charge generating layer divided into five equal regions from a central position to an end position of the image forming region in an axis direction of the cylindrical support in order from the central position towards the end position, $d_{21}>d_{22}>d_{23}>d_{24}>d_{25}$ where $d_{21}$, $d_{22}$, $d_{23}$, $d_{24}$ and $d_{25}$ are respectively average film thicknesses (μm) of the charge transport layer divided into five equal regions from the central position to the end position in order from the central position towards the end position, and each of $d_{11}\times d_{21}$, $d_{12}\times d_{22}$, $d_{13}\times d_{23}$, $d_{14}\times d_{24}$, and $d_{15}\times d_{25}$ is 1.0 to 3.0.

2. The electrophotographic photosensitive member according to claim 1, wherein a standard deviation of five values calculated by $d_{11}\times d_{21}$, $d_{12}\times d_{22}$, $d_{13}\times d_{23}$, $d_{14}\times d_{24}$, and $d_{15}\times d_{25}$ is 0.3 or less.

3. The electrophotographic photosensitive member according to claim 1, wherein the charge transport layer contains a charge transport substance and a binding resin, and a mass ratio of the charge transport substance to the binding resin is 1/2 to 2/1.

4. The electrophotographic photosensitive member according to claim 1, wherein the charge generating layer contains a charge generating substance and a binding resin, the charge generating substance being a phthalocyanine pigment, and a mass ratio of the charge generating substance to the binding resin being 1/5 to 5/1.

5. The electrophotographic photosensitive member according to claim 1, wherein $$\frac{1-e^{-2\beta d_0}}{1-e^{-2\beta d_0}} \geq 1.2$$

when $\beta(\mu m^{-1})$ is a light absorption coefficient of the charge generating layer, $d_0$ (μm) is a film thickness of the charge generating layer in the central position, and $d_6$ (μm) is a film thickness of the charge generating layer in the end position.

6. A process cartridge integrally supporting an electrophotographic photosensitive member and at least one unit selected from the group consisting of a charging unit, a developing unit, a transfer unit and a cleaning unit, the process cartridge being detachably attachable to a main body of an electrophotographic apparatus, the electrophotographic photosensitive member comprising a cylindrical support, a charge generating layer formed on the cylindrical support, and a charge transport layer formed on the charge generating layer, wherein $d_{11}<d_{12}<d_{13}<d_{14}<d_{15}$ where $d_{11}$, $d_{12}$, $d_{13}$, $d_{14}$ and $d_{15}$ are respectively average film thicknesses (μm) of the charge generating layer divided into five equal regions from a central position to an end position of the image forming region in an axis direction of the cylindrical support in order from the central position towards the end position, $d_{21}>d_{22}>d_{23}>d_{24}>d_{25}$ where $d_{21}$, $d_{22}$, $d_{23}$, $d_{24}$ and $d_{25}$ are respectively average film thicknesses (μm) of the charge transport layer divided into five equal regions from the central position to the end position in order from the central position towards the end position, and each of $d_{11}\times d_{21}$, $d_{12}\times d_{22}$, $d_{13}\times d_{23}$, $d_{14}\times d_{24}$, and $d_{15}\times d_{25}$ is 1.0 to 3.0.

7. An electrophotographic apparatus, comprising:

an electrophotographic photosensitive member including a cylindrical support, a charge generating layer formed on the cylindrical support, and a charge transport layer formed on the charge generating layer;

a charging unit;

an exposing unit;

a developing unit; and a transfer unit, wherein $d_{11}<d_{12}<d_{13}<d_{14}<d_{15}$ where $d_{11}$, $d_{12}$, $d_{13}$, $d_{14}$ and $d_{15}$ are respectively average film thicknesses (μm) of the charge generating layer divided into five equal regions from a central position to an end position of the image forming region in an axis direction of the cylindrical support in order from the central position towards the end position, $d_{21}>d_{22}>d_{23}>d_{24}>d_{25}$ where $d_{21}$, $d_{22}$, $d_{23}$, $d_{24}$ and $d_{25}$ are respectively average film thicknesses (μm) of the charge transport layer divided into five equal regions from the central position to the end position in order from the central position towards the end position, and each of $d_{11}\times d_{21}$, $d_{12}\times d_{22}$, $d_{13}\times d_{23}$, $d_{14}\times d_{24}$, and $d_{15}\times d_{25}$ is 1.0 to 3.0.

* * * * *